United States Patent [19]

Heisler

[11] Patent Number: 4,515,466

[45] Date of Patent: May 7, 1985

[54] SHEET DELIVERY STATION FOR COPYING APPARATUS

[75] Inventor: Carl B. Heisler, Victor, N.Y.

[73] Assignee: Xerox Corporation, Stamford, Conn.

[21] Appl. No.: 382,514

[22] Filed: May 27, 1982

[51] Int. Cl.[3] ..... G03G 21/00; G03G 15/20

[52] U.S. Cl. ..... 355/15; 355/3 FU

[58] Field of Search ..... 355/3 R, 3 FU, 14 FU, 355/15

[56] References Cited

U.S. PATENT DOCUMENTS

| | | | |
|---|---|---|---|
| 2,958,593 | 11/1960 | Hoover et al. | 51/295 |
| 3,080,688 | 3/1963 | Politzer | 51/185 |
| 3,424,526 | 1/1969 | Sacre | 355/10 |
| 3,441,345 | 4/1969 | Kolibas | 355/10 |
| 3,716,018 | 2/1973 | Ohta et al. | 355/3 FU X |
| 3,745,972 | 1/1973 | Thettu | 118/261 |
| 3,766,593 | 10/1973 | Becker et al. | 355/15 X |
| 3,878,818 | 4/1975 | Thettu et al. | 355/15 X |
| 3,966,394 | 6/1976 | Braun | 432/75 |
| 4,083,322 | 4/1978 | Beckman, Jr. | 118/70 |
| 4,324,482 | 4/1982 | Szlucha | 355/15 X |

*Primary Examiner*—Fred L. Braun

[57] ABSTRACT

A reproducing apparatus for producing a toner image on a supporting substrate including an image fuser or fixer device which elevates the temperature of the toner to a level at which it at least softens, and sheet delivery exit rolls adjacent to the toner fixing device for transporting a sheet to the output station. The sheet delivery roll in contact with the toner image side of the sheet is provided with a cleaning pad for cleaning the surface of the exit roll of toner and debris which is made from inflammable resiliently compressible flexible abrasive fibers. Typically the pad is impregnated with abrasive particles. In a preferred embodiment the cleaning pad is also impregnated with a toner release fluid and is mounted on top of the top transport roll and extends the length of the top transport roll and rests thereon by virtue of its own weight.

14 Claims, 4 Drawing Figures

SHEET DELIVERY STATION FOR COPYING APPARATUS

REFERENCE TO COPENDING APPLICATIONS

Reference is hereby made to copending application Ser. No. 210,966, now U.S. Pat. No. 4,324,482, of Thomas F. Szlucha filed Nov. 28, 1980 and entitled Pressure Roll Cleaning Device which is commonly assigned to the assignee of the present invention.

BACKGROUND OF THE INVENTION

This invention relates generally to electrostatographic copying apparatus and more particularly to a sheet delivery system for such apparatus. In particular it is directed to an improved sheet delivery system for use in apparatus wherein the toner image is at least, in part, fixed to a support sheet by the application of heat.

In the process of xerography a light image of an original to be copied is typically recorded in the form of an electrostatic latent image upon a photoconductive insulating member with subsequent rendering of the latent image visable by the application to the photoconductive insulating member of electroscopic marking particles commonly referred to as toner. This visual image can either be fixed directly on the photoconductive insulating member or transferred from that member to a image receiving member such as plain paper with subsequent affixing of the image thereto.

It is common practice to permanently affix or fuse the toner material onto the support member by heat. In this process it is necessary to elevate the temperature of the toner material to a point at which the constituents of the toner become tacky and coalesce. At this time the softening causes the toner to be absorbed to some extent into the fibers of the support member which in many instances is plain paper. Thereafter as the toner material cools, solidification of the toner material occurs causing the toner material to be firmly bonded to the support member. Typically the heat necessary to provide such fusing is supplied with a radiant fuser device, such as that generally illustrated in FIG. 1.

In a typical commercial embodiment, such as the Xerox 3400, or 3450 products, to facilitate handling of the individual copies a sheet delivery system is provided adjacent to the radiant fuser. Typically the sheet delivery systems comprise a pair of rolls, one of which is driven, the other which is friction driven by being in contact with the driven roll. Typically these rolls get hot after prolonged use as a result of the proximity to the fuser which is at elevated temperature and the contact with heated paper. This is particularly prevalent in the high use, high volume machines which are constantly run over long periods of time so that heat buildup in the delivery rolls becomes excessive. For example, on long runs, it has been found that the delivery rolls may reach a temperature of up to 180° F., a temperature at which the toner will not solidify but softens and transfers to any surface with which it comes in contact. In the sheet delivery system, such as that illustrated in FIG. 1, the softened toner may offset from the copy sheet to the transport roll with which it comes in contact. And since this roll is hot from prolonged use in proximity to the fuser and being in contact with the heated paper, the toner may remain soft and transfer to subsequent copies. Thus the transport roll may pick up tone from a first sheet of paper and transfer it back onto subsequent copy sheets. In addition, paper fibers or other debris may be held by the soft toner on the transport roll. Both of these effects may be particulary pronounced with a sheet delivery roll which has ridge points which are circular raised rings around the periphery of the transport roll and which serve as the driving force between the idler top transport roll and the bottom driven roll. With the toner offsetting to these ridge parts, offsetting of the toner onto subsequent copies occurs in the form of streaks.

Furthermore, after the toner builds up on the roll to any significant degree, the paper may tend to stick to the roll causing a paper jam. Once the jam is caused in the delivery roll system, it is possible that the paper may buckle within the fuser and come in contact with fuser elements. When this happens the paper overheats, tends to char and eventually contaminates the system. Once the system is contaminated a skilled technician may be needed to clean the entire fuser and sheet delivery system.

PRIOR ART

Attempts to alleviate the above-mentioned difficulties have, in the past, involved devices such as the use of a heat pipe as the top idler member of the delivery roll pair. In this type of device the delivery roll comprises a cylinder which is filled with a fluid. Fins at the end of the delivery roll provide a large cooling surface for the dissipation of heat. While this works to a satisfactory degree, it is very expensive to manufacture and very difficult and time consuming to install when a new assembly or a replaceable assembly is desired. Furthermore, while such devices are effective in dissipating heat of relatively low usage levels, they are less effective at dissipating heat at very high usage levels, such as when the machine is run constantly for an extended period of time. In this mode of operation, the delivery roll heats up to extremely high temperatures and the problem may be once again realized.

An additional approach to this problem is that described in British Pat. No. 1,257,498 where a pair of spaced apart rollers are placed in pressure contact with a lower roller between which the sheet bearing the toner image is passed. The pair of rollers engage the sheet surface bearing the tacky material and are of a porous nature impregnated with a non-volatile liquid imparting adhesion resistant properties to the roller surface. A specified roller is of powdered bronze which has been sintered and compressed to form a porous metal body which is impregnated with a liquid that prevents the adhesion of the softened resin to the surface of the roll. The porous rolls are prepared by being immersed in a bath of silicone oil and simultaneously subjected to sub-atmospheric pressures so that air is scavenged from the pores and replaced by the silicone oil. The liquid in the roll comes to the surface of the porous roll by capillary action. As indicated at page 2, lines 89–93 with protracted use such rollers require cleaning by wiping and then applying a thin film of silicone oil.

SUMMARY OF THE INVENTION

Accordingly it is an object of the present invention to provide a novel sheet delivery system. It is a further object of the present invention to provide a improved sheet delivery system for delivering sheets containing fused toner images from a fuser to a sheet output station.

It is a further object of the present invention to provide a relatively simple inexpensive sheet delivery system.

It is an additional object of the present invention to provide a means for cleaning a sheet delivery system adjacent to a radiant fuser.

It is a further object of the present invention to provide a cleaning system for a sheet delivery roll which is relatively inexpensive and which may be readily installed.

It is a further object of the present invention to provide a sheet delivery system which is capable of working continuously for extended periods of time without toner offsetting to copy sheets.

In accordance with the present invention, an improved sheet delivery means for an automatic reproducing apparatus is provided. In particular, the reproducing apparatus comprises means for forming a toner image on a supporting sheet, means for fixing the toner image to the sheet, the fixing means including a means to elevate the temperature of the toner to a level at which it at least softens, and sheet delivery means for delivering the sheet from the fixing means to an output station. The sheet delivery means comprises a pair of transport rolls through which the sheet, with the toner image is transported and the roll in contact with the side of the sheet bearing the toner image has associated therewith a cleaning pad for cleaning the surface thereof of toner and debris. The cleaning pad comprises an inflammable pad of resiliently compressible flexible abrasive fibers. Typically, the pad is impregnated with abrasive particles.

In a specific aspect of the present invention, the cleaning pad is also impregnated with a toner release fluid to facilitate the separation of toner particles from the transport roll in contact with the toner image side of the sheet being delivered. In another aspect of the present invention, the cleaning pad comprises a non-woven web defining a tri-dimensionally extending network of intercommunicating voids such that about 75% of the total volume is made up of voids. In a further aspect of the invention, the bottom roll of the pair of transport rolls is driven with the top roll being driven by friction contact therewith or by contact with a sheet placed therebetween. The cleaning pad is mounted relative to the top roll such that it rests of its own weight on the top of said top roll.

For a better understanding of the invention as well as other objects and further features thereof, reference is had to the following drawings and descriptions.

DESCRIPTION OF THE PREFERRED EMBODIMENT

The invention will now be described with reference to preferred embodiment of the reproducing apparatus sheet delivery means.

Figure 1:
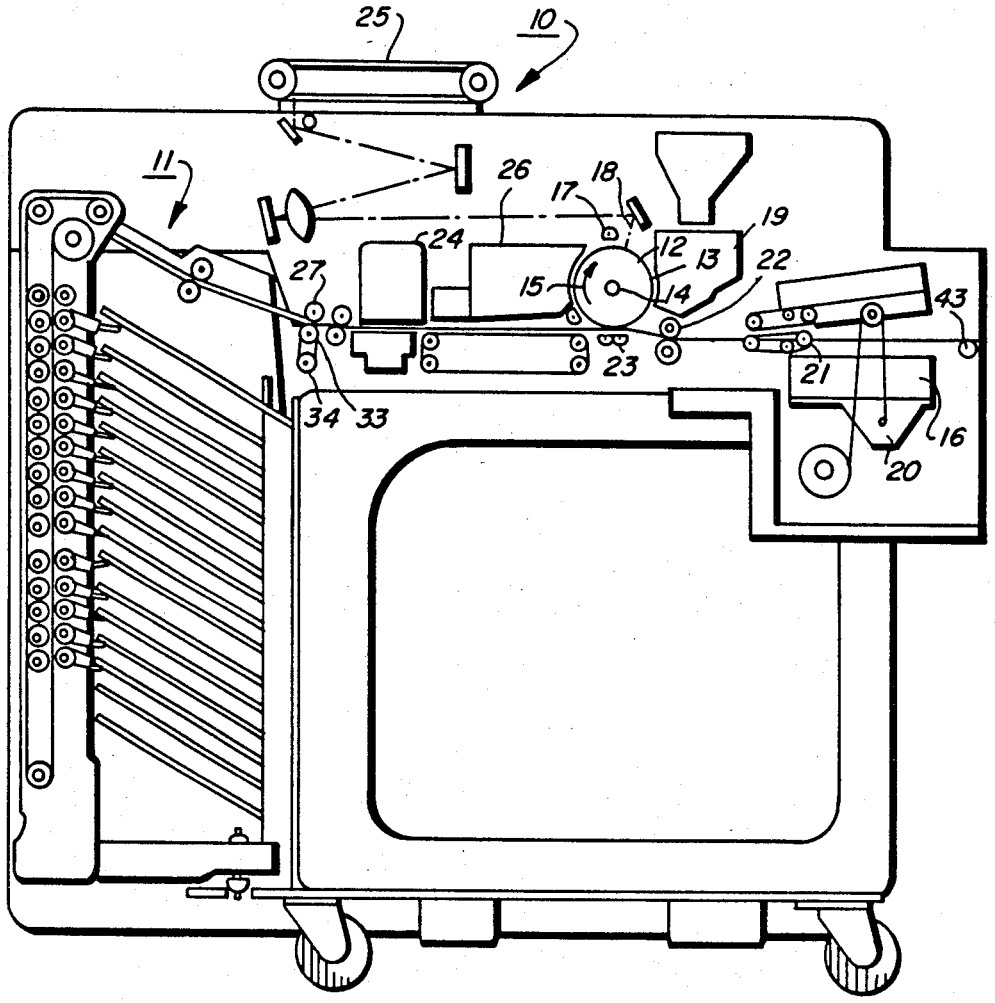
FIG. 1 is a schematic representation of an automatic xerographic reproducing apparatus employing the copy output station of the present invention.

Referring now to FIG. 1 there is shown by way of example an automatic xerographic reproducing machine 10 which includes the sheet delivery apparatus of the present invention. The reproducing machine 10 depicted in FIG. 1 illustrates the various components utilized therein for producing copies from an original. Although the apparatuses of the present invention are particularly well adapted for use in an automatic xerographic reproducing machine 10, it should become evident from the following description that they are equally well suited for use in a wide variety of processing systems including other electrostatographic system and they are not necessarily limited in their application to the particular embodiment or embodiments shown herein.

The reproducing machine 10 illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17. In the charging station 17 an electrostatic charge is uniformly placed over the photoconductive surface 13 preparatory to imaging.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface 13 of the drum 12 rendering the latent image visible. Typically the development station comprises a magnetic brush development system utilizing a magnetizable developer mix having coarse ferromagnetic carrier granules and colored toner particles. The developer mix is brought through a directional flux field to form a brush thereof and the electrostatic latent image recorded on the photoconductive surface 13 is developed by bringing the brush of developer mix into contact therewith.

Sheets 16 of final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 11.

Although a preponderance of the toner powder is transferred to the final support material 16, invariably some residual toner remains on the photoconductive surface 13 after the transfer of the toner image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, the use of a blade.

It should be understood however, that the described apparatus when used for high volume applications, generally is associated with some type of automatic document handler 25 and some type of high volume sheet collection device such as the sorter 11 generally illustrated in FIG. 1.

Figure 2:
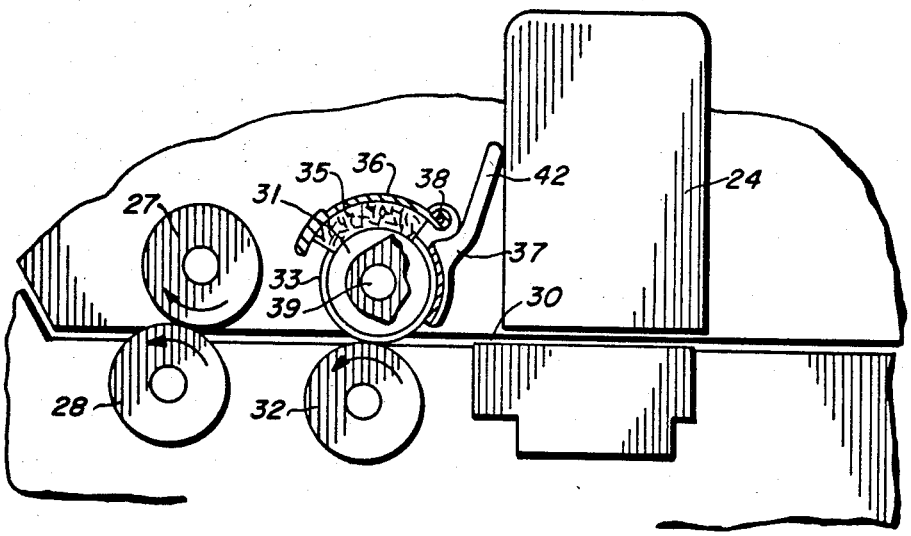
FIG. 2 is an enlarged schematic representation of the fuser and sheet delivery system illustrated in FIG. 1 with the sheet delivery system in the operative position.
Figure 3:
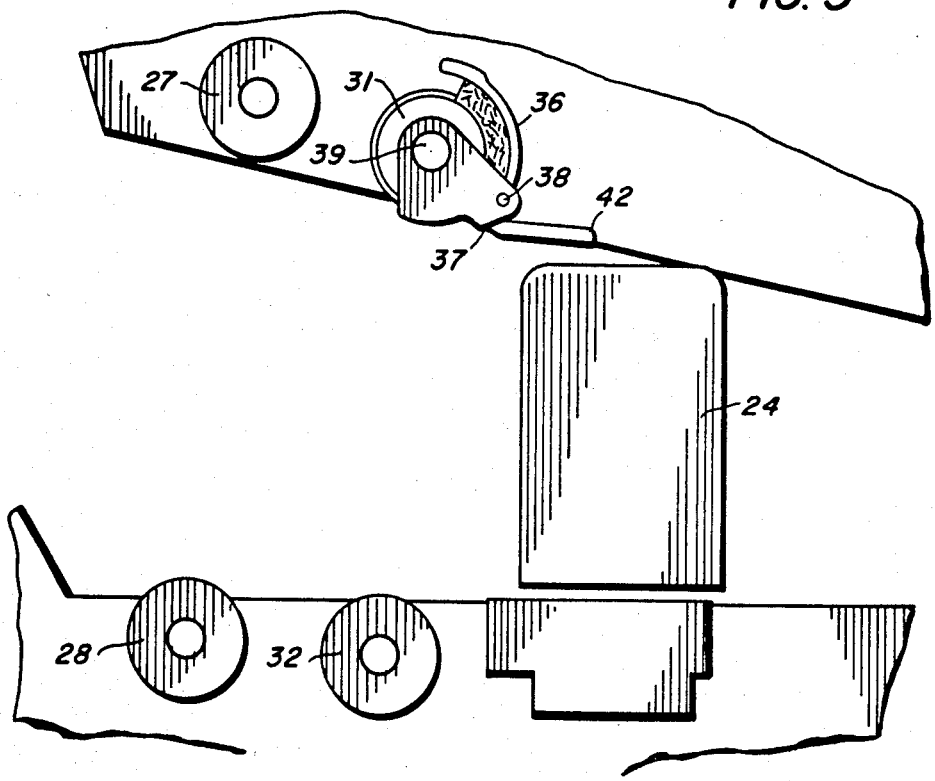
FIG. 3 illustrates the position of sheet delivery system when the machine is opened.
Figure 4:
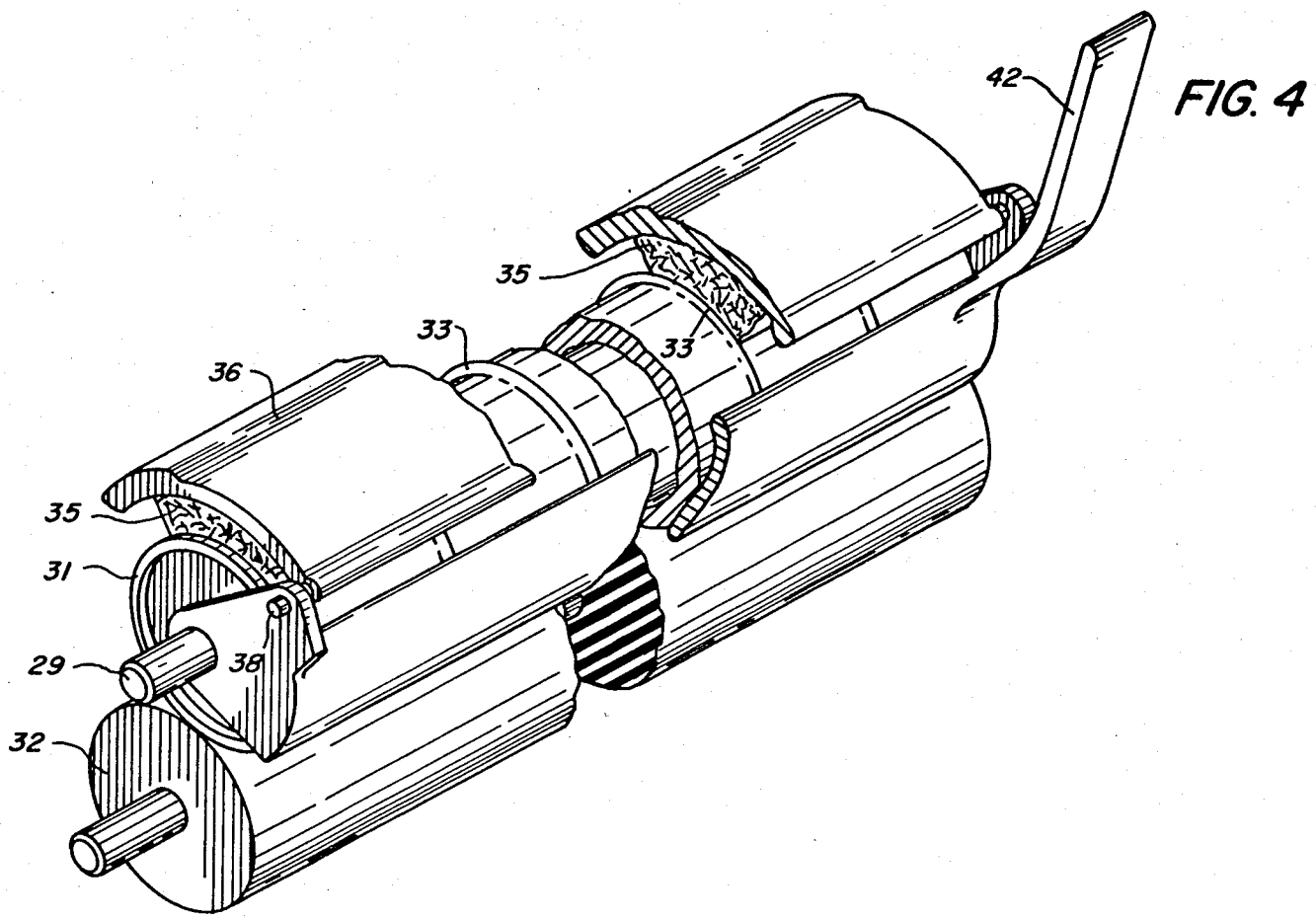
FIG. 4 is an isometric view of the two roll sheet delivery system according to the present invention.

Reference is now made to FIGS. 2–4 where the sheet delivery system and toner fixing apparatus are illustrated in somewhat greater detail. As a sheet 30 exits from fuser 24 where the toner image on the top of the sheet has been heated and coalesced with some of the toner penetrating below the surface of the sheet to form a more permanent image it immediately comes into contact with sheet delivery roll pair 31, 32, the bottom delivery roll 32 of which is positively driven by means not shown, to feed the sheet from the fuser in a forward direction. Top delivery roll 31 which has a plurality of cylindrical ridges 33 spaced about 1 inch apart along the entire length of the roll is an idler roll and is driven by being in friction contact with the bottom delivery roll or by being in contact with the sheet being fed through the nip formed by the top and bottom delivery roll. From delivery roll pair 31 and 32 the sheet is fed further foward to roll pair 27, 28 the bottom roll 28 being driven while upper roll 27 is idle, for distribution to a sheet output station such as sorter 11.

In accordance with the present invention the top delivery roll is provided with a cleaning pad 35 held in place by pad support 36 near the top of the top delivery roll 31. In this way the cleaning pad is held against the delivery roll 31 merely by the weight of the pad. The pad support member 36 like the cleaning pad 35, extends across the entire length of the top delivery roll with the pad support 36 being pivotally mounted about pins 38 to side support brackets 37 at each end of the top delivery roll. The side support brackets in turn are swingably mounted about the axis 39 of the top delivery roll 31. The side support brackets are also provided with a positioning arm 42 for positioning the cleaning pad in the appropriate orientation relative to the top delivery roll.

In the copying machine illustrated in FIG. 1, the fuser 24 and lower delivery roll 32 are mounted in a lower machine frame member which is pivotally mounted about one end at pivot point 43 to the upper machine member which houses top delivery rolls 31 and 27. Thus when the top frame member is opened, the top delivery roll 31 is moved up and away from the bottom delivery roll 32 and fuser housing 24 whereby the positioning arm is unrestricted by the fuser housing and falls by gravity to the bottom of the top delivery roll 31 as illustrated in FIG. 3. This may occur, for example, when the machine is opened for routine maintenance or to clear a paper jam. When in the opened position and since the top delivery roll is hot as is the cleaning pad support, the lower most portion of the pad support is provided with an insulating gauze or felt fabric so that one inserting his hand or arm does not touch the hotest element. This reduces the possibility of injury to the operator or service man. When the top frame is lowered from the raised or open position to the closed operative position, the positioning arm 42 contacts fuser housing 24, riding down the side and positions the cleaning pad at the top of the top delivery roll. In this manner the cleaning pad rests on the top of the top delivery roll by virture of its own weight.

As previously discussed, the top delivery roll has a plurality of circular raised portions 33 along its length which are in friction driving contact with the driven bottom roll. Typically these ridges are of the order of about 0.015 inches high and are the only portion of the top delivery roll which comes into contact with the toner on the copy sheet, the toner having been at least softened by the fuser but more typically, having been coalesced or melted to penetrate into the fibers of the paper. The cleaning pad may be made of any suitable material that can continuously clean and polish the top delivery roll with which it is in physical contact. By the continuous physical contact the abrasive nature of the pad continuously loosens any toner particles that may offset to the delivery roll particularly on the plurality of ridges with which the paper holding the toner images comes in direct contact. The action of the pad can essentially be described as a scouring action which keeps the delivery roll smooth and clean.

Typically the cleaning pads are made of inflammable resilient compressible flexible fibers which are abrasive enough to continuously remove toner from the ridges of the delivery roll and maintain the roll in a polished condition. The pad typically has a relatively high volume of voids so that as the toner is scoured or scrapped off the delivery roll, the toner particles are pushed into the space or voids within the pad for storage. Of course, it should be noted that some of the solidified toner particles which the cleaning pad scrapes off the delivery roll may not adhere to the cleaning pad or be pushed into the voids within the pad, but rather may just fall by gravity within the machine or may even loosely fall onto the copy sheet being delivered.

Typically the cleaning pad is a non-woven web with a tri-dimensional extending networks of intercommunicating voids such that about 75% of the total volume is made up of voids. To assist in insuring the cleaning pad does an effective cleaning it may be impregnated with abrasive particles which more effectively scour and clean the surface of the delivery rolls. Typical abrasive materials include aluminum oxide, silicone carbide, and flint, and mixtures thereof.

In a preferred embodiment the pad may comprise a lofty, open non-woven compressible fibrous abrasive member. Such a pad may be formed from a uniform lofty open non-woven lightweight web of many interlaced randomly disposed flexible durable tough organic fibrous members. The lofty fibrous web is unified preferably by an organic binder which bonds web fibers firmly together at points where they intersect and contact one another. Distributed within the web and firmly bonded to the fibrous members thereof are the abrasive particles, the many interstices between adjacent fibers remaining substantially unfilled by adhesive and abrasive particles so that at least about 75% of the total volume of the pad is made up of a tri-dimensional extending network of intercommunicated voids. Pads of this type are described in greater detail in U.S. Pat. No. 3,080,688 granted Mar. 12, 1963 to Politzer and U.S. Pat. No. 2,958,593 granted Nov. 1,1960 to Hoover et al, the disclosures of which are hereby totally incorporated by reference.

The pad may be made of any suitable inflammable material. In the present context the term inflammable means that at least the direct application of flame to the pad is required to ignite the pad. Typical materials include fibrous pads made from polyester materials, cellulosic materials and for certain relatively low temperature applications, even nylon. It is generally desirable for the web to have a bulk density between about 0.05 and 0.2 grams per cubic centimeter and that the web fibers have a thickness between 5 and 50 denier. The shape and thickness of the pad may be designed to suit the particular fuser apparatus in which it is used. It is contemplated that thickness will vary between about ⅛ to ½ inch and preferably will be about ¼ inch. The pad should extend along the entire operational length of the delivery roll. Typical pad materials include Scotch-Brite® a nylon mesh impregnated with abrasive flint particles available from 3-M Company, Minneapolis, Minnesota, and a polyester pad available from R. P. Fedder Inc., Rochester, New York under the designation No. W3497.

To assist in the toner separation from the delivery roll it is preferred that the cleaning pad be impregnated with a toner release fluid which permits the toner to be more readily or easily removed by the abrasive pad. The toner release fluid once applied coats the delivery roll in a thin layer about 0.05 to 0.20 inches thick thereby making it more difficult for the toner particles to firmly adhere to the surface of the roll, particularly the ridges, and thereby also facilitating the separation of toner by the fibrous cleaning pad. Any suitable toner release fluid may be employed. Typical materials include silicone oils which posses relatively low surface energy and thereby prevents the toner from offsetting to the transport roll. Typical materials include silioxanes such as polydimethyl siloxane and polymethyl phenyl siloxane. Suitable such materials are available from Dow Corning Corporation. A preferred material is Dow Corning silicone oil No. 200 having a kinematic viscosity of about 200 centistokes.

To illustrate the beneficial effects achieved according to the present invention, a Xerox 3450 machine was tested and compared with and without the cleaning pad according to the present invention. In the instance where no cleaning pad was used, the machine was operated continuously for about 7,000 copies before the delivery roller in contact with the toner side of the copy became contaminated with toner which commenced to offset or transfer to the copy sheet at the ridges leaving undesirable marks on the copy sheet. In addition the copy paper began to stick to the delivery roll soon resulting in a paper jam which had to be cleared. By contrast when a cleaning pad according to the present invention comprising a non-woven web of a tri-dimensionally extending network of interconnecting voids impregnated with abrasive flint particles such as "Scotchbrite Superfine"® and also impregnated with polydimethyl siloxane (Dow Corning silicone oil No. 200) was installed in the manner depicted in the figures, the same machine operating with the same toner ran continuously for from between 35,000 copies and 70,000 copies before similar difficulties were encountered. It can readily be seen that the cleaning pad according to the present invention, provides a dramatic improvement in maximum run length before difficulties are encountered. It also enables the Xerox 3450 and other machines to which applied to be capable of greatly extended copy run lengths without creating streaking in the copies produced. Furthermore, the cleaning pad including its holder and mounting brackets is simple, relatively inexpensive, and can be installed in just a few minutes. For example, the device described in this application can be manufactured for less than $10 and installed in a Xerox 3450 in about 10 minutes. This is to be contrasted to the heat pipe arrangement described above which costs over $150 and requires about two hours to install by a trained technician.

The patents and text referred to specifically in this application are intended to be incorporated by reference into this application.

In accordance with the invention a new sheet delivery station for a copying apparatus has been provided. In particular a sheet delivery station including a cleaning pad for cleaning the surface of a delivery roll from toner and debris has been provided. This cleaning pad enables the machine employing same to operate in a continuous fashion for extended periods of time which were not heretofore possible. While the present invention has been described with particular reference to a radiant fuser, it should be understood that this invention has application to any fixing device which heats the toner to a temperature at which it softens or melts. It may, for example, be equally useful in a copying apparatus adjacent to a heated roll fuser. Furthermore, while the invention has been described with particular reference to a system where the top delivery roll is in contact with the imaged copy sheet, it could be equally well used in a system in which the bottom delivery roll would be in contact with toner bearing copy sheet. It is intended that these embodiments as well as other specific embodiments that will be apparent to those skilled in the art and the many alternatives, modifications or variations that also may be made available to those skilled in the art are intended to be embraced and fall within the scope and the spirit of the appended claims.

I claim:

1. Reproducing apparatus comprising a frame having upper and lower portions, means for forming a dry toner image on a supporting sheet, means for fixing a toner image to said sheet, said fixing means including heating means to elevate the temperature of the toner to a level at which it at least softens, sheet delivery means for delivering said sheet from said fixing means to an output station, said sheet delivery means being positioned adjacent said fixing means and comprising a pair of transport rolls through which the sheet with said toner image is transported, said fixing means and the lower one of said transport rolls being mounted to the lower portion of the reproducing apparatus frame and the upper one of said transport rolls being mounted to the upper portion of the reproducing apparatus frame, said upper and lower frame portions being pivotally mounted relative to each other at one end, said upper roll in contact with the side of the sheet bearing the toner image having associated therewith a cleaning pad for cleaning the surface thereof of toner and debris, said cleaning pad being pivotally supported by a frame member about the axis of the upper roll, said cleaning pad comprising an inflammable pad of resiliently compressible flexible abrasive fibers forming a network of intercommunicating voids to scrape toner off the surface of said upper transport roll whereby said toner penetrates the voids of said cleaning pad.

2. Reproducing apparatus according to claim 1 wherein said cleaning pad is impregnated with toner release fluid.

3. Reproducing apparatus according to claim 2 wherein said cleaning pad comprises a non-woven web impregnated with toner release fluid.

4. Reproducing apparatus according to claim 2 wherein said cleaning pad is impregnated with abrasive particles.

5. Reproducing apparatus according to claim 4, wherein said toner release fluid is polydimethyl siloxane.

6. Reproducing apparatus according to claim 4, wherein said cleaning pad comprises a tri-dimensionally extending network of intercommunicating voids such that about 75% of the total volume is made up of voids.

7. Reproducing apparatus according to claim 6, wherein said abrasive particles are aluminum oxide, silicone carbide or flint.

8. Reproducing apparatus according to claim 7 wherein said fixing means comprises a radiant fuser.

9. Reproducing apparatus according to claim 8, wherein said upper roll has circular spacing ridges spaced uniformly along its axial dimension.

10. The reproducing apparatus according to claim 9, wherein said lower roll is driven and said upper roll is driven by contact with said lower roll, and wherein said cleaning pad is mounted relative to said upper roll such that it rests of its own weight on said upper roll.

11. Reproducing apparatus according to claim 8, wherein said frame member has a positioning tab member at its rear for operative communication with the housing of the radiant fuser when said frame portions are closed whereby said cleaning pad strip is positioned at the top of said upper roll such that it rests of its own weight on top of said upper roll.

12. Reproducing apparatus according to claim 2 wherein said toner release fluid assists in the separation of toner from said upper transport roll and in the reduction of the amount of toner subsequently adhering to said upper transport roll.

13. Reproducing apparatus according to claim 12, wherein said transport roll in contact with the side of the sheet bearing the toner image is hard and nonconformable.

14. Reproducing apparatus according to claim 13 wherein said upper transport roll has a plurality of circular spaced raised ridges along its length, said raised ridges providing friction driving contact with a driven lower transport roll.

* * * * *